United States Patent [19]

Peterson

[11] 4,269,209

[45] May 26, 1981

[54] SERIAL FLOW PHOTOGRAPHIC WASHER

[76] Inventor: Stephen C. Peterson, 3791 S. 1860 E., Salt Lake City, Utah 84106

[21] Appl. No.: 164,832

[22] Filed: Jun. 30, 1980

[51] Int. Cl.[3] ..... B08B 3/04; G03D 3/02

[52] U.S. Cl. ..... 134/182; 134/186; 354/324; 354/331; 366/166

[58] Field of Search ..... 354/324, 326, 328, 331; 366/166; 134/109, 154, 182, 183, 186

[56] References Cited

U.S. PATENT DOCUMENTS

| | | | |
|---|---|---|---|
| 661,819 | 11/1900 | Salomon | 354/326 |
| 3,657,990 | 4/1972 | Wilhelm | 354/331 X |
| 4,001,855 | 1/1977 | Wilhelm | 354/331 X |
| 4,143,976 | 3/1979 | Paterson | 366/166 X |
| 4,185,911 | 1/1980 | Guillemette | 354/331 X |

*Primary Examiner*—L. T. Hix
*Assistant Examiner*—Alan Mathews

[57] ABSTRACT

A sequential flow washer for photographic prints and film consisting of a tank having sidewalls, endwalls and a base, said tank being divided into multiple compartments by a series of alternately arranged baffles located between the sidewalls, one of said baffles being an overflow baffle and the adjacent baffle being an underflow baffle. From an intake manifold, water overflows one sidewall into the first of the multiple compartments and then flows down through said compartment which is created by an underflow baffle and up into the next compartment defined by an overflow baffle and over the top thereof and continues serially through compartments created by alternating underflow and overflow baffles and out over the opposite sidewall into an exit manifold. The upper edges of both sidewalls are preferably slotted to allow for the uniform flow of water into and out of the adjacent manifolds.

10 Claims, 3 Drawing Figures

SERIAL FLOW PHOTOGRAPHIC WASHER

BACKGROUND OF THE INVENTION

This invention relates to a sequential flow washer for photographic prints and films. It is a washer which by its sequential flow pattern through individual compartments washes photographic prints and film placed therein using minimal wash water.

Often prints which have been placed in a photographic print washer are contaminated by subsequent insertion of photographic prints laden with fixer. This may especially be true where resin coated paper prints requiring a short washing period are placed in a washer with previously processed prints.

U.S. Pat. No. 3,657,990 issued Apr. 25, 1972 teaches a washer for fiber based paper prints with separately spaced washing units whereby the prints were kept separate from each other and simultaneously washed and aerated with relatively large amounts of water. An improvement of this washer is claimed in U.S. Pat. No. 4,001,855 issued Jan. 4, 1977. The improvement allowed for washing of resin coated photographic prints without the use of partitions. The fact that no partitions were used, required that a high flow rate be maintained to keep contamination from occurring.

There is a need to more effectively regulate and use photographic wash water, whether in a low flow rate fiber based paper print washer or with higher flow rate resin coated photographic print washers. Yet the conservation and wise use of water should not result in a more contaminated environment for photographic print and film washing.

OBJECTS AND SUMMARY OF THE INVENTION

It is an object of the present invention to provide a system for washing photographic prints and films.

It is also an object of the present invention to serially wash prints in an apparatus such that partially or fully washed prints are not contaminated with fixer laden prints which have been washed less.

Another object of the present invention is to provide a means whereby large prints may also be washed.

It is a further object of the present invention to deliver the wash water in an even flow pattern thereby uniformly washing the prints or film.

These and other objects are accomplished by means of a system consisting of a compartmentalized tank with opposing ends, opposing sides and a base. The space between the sidewalls is divided into a series of compartments by a series of parallel alternating overflow and underflow baffles. Exit and entrance port manifolds are located at the sides of the tank. The entering water flows uniformly into the first compartment due to slots cut in the entrance manifold system and flows sequentially through the compartments. Maximum use of the water is made by allowing sequential flow of water through the narrowly spaced compartments with less contaminated water washing prints or films with greater fixer content. The small compartmental volumes also help conserve water usage by increasing the compartment exchange rate. Each compartment is defined by an underflow baffle terminating at the lower end a spaced distance from the base to permit water flow under the baffle, and by an overflow baffle over which the wash water flows. The overflow baffle is in fluid-tight relationship with the floor and ends of the tank. The underflow baffle is in fluid-tight relationship with the ends of the tank. In order to accommodate large prints, they may be draped over an overflow baffle so that they are thoroughly and uniformly washed by the overflow water.

DRAWINGS OF THE INVENTION

DETAILED DESCRIPTION OF THE INVENTION

Figure 1:
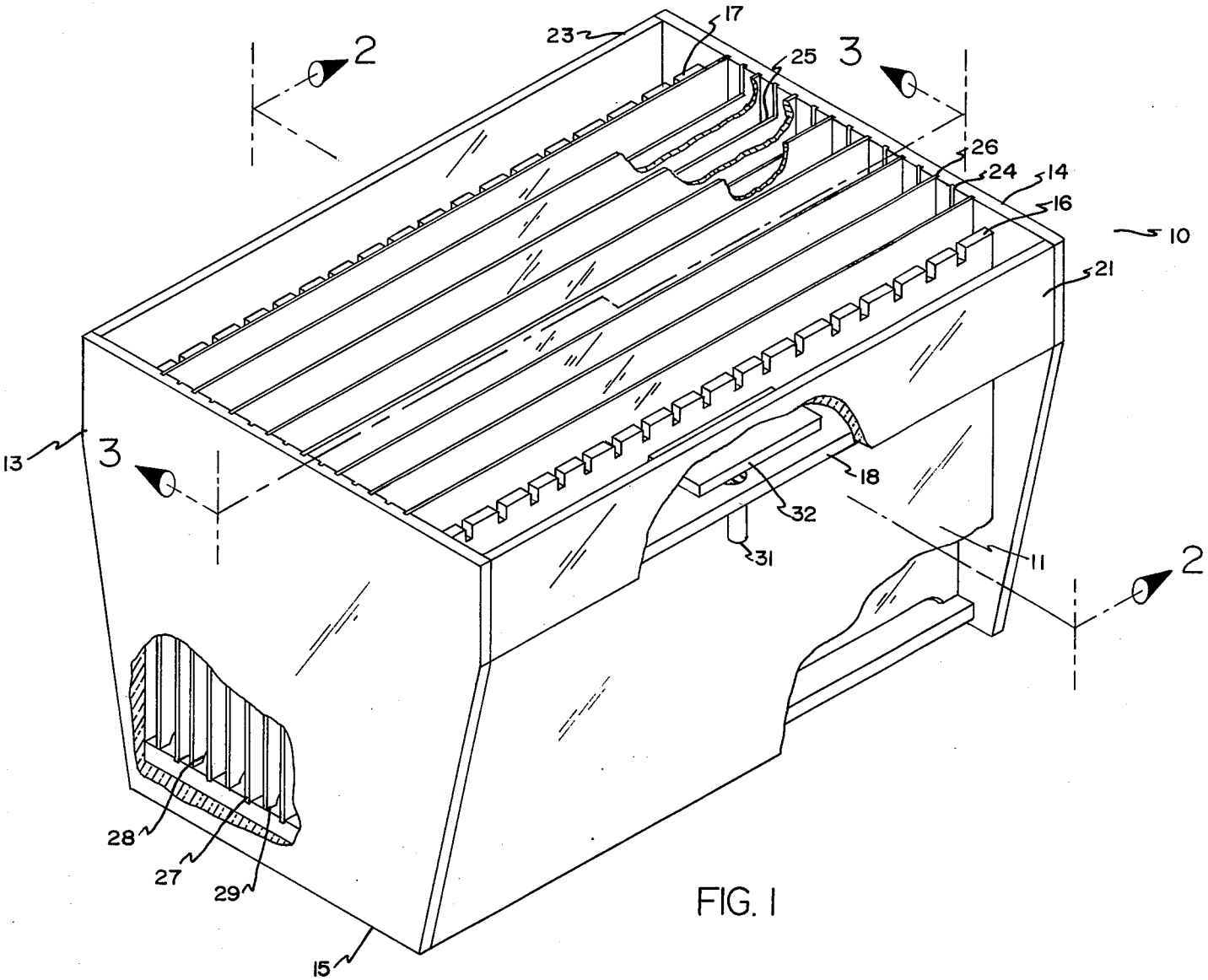
FIG. 1 is a pictorial view of the sequential flow photographic print and film washer with several portions thereof cut away to show inner detail.
Figure 2:
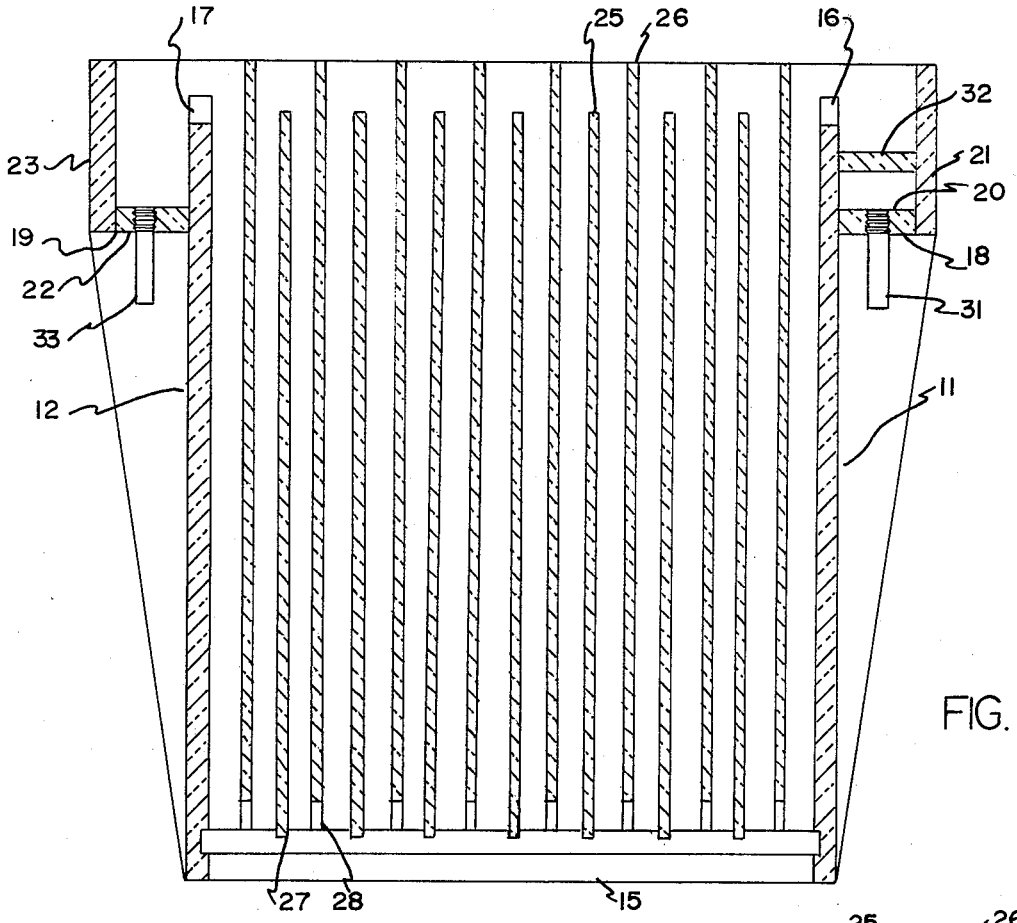
FIG. 2 is an end cross-sectional view of the sequential flow washer along lines 2—2 of FIG. 1.
Figure 3:
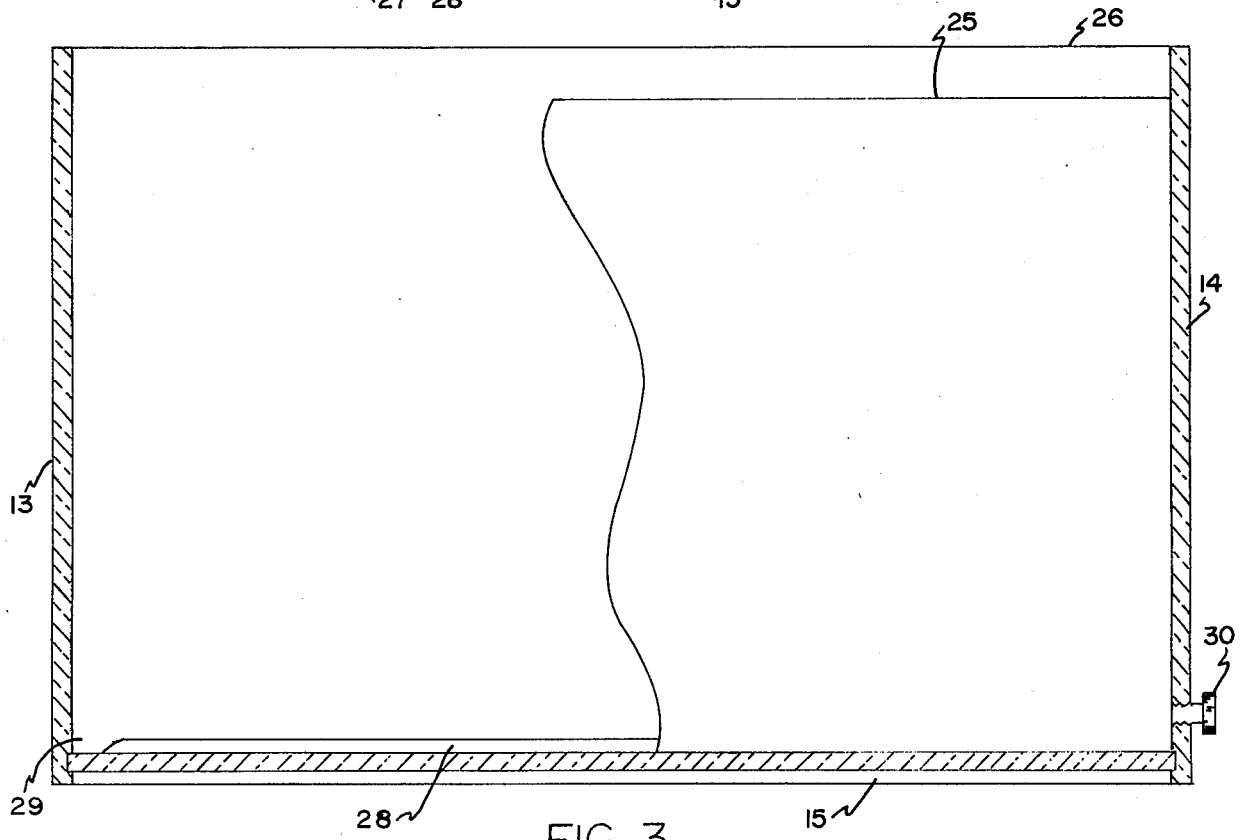
FIG. 3 is a side cross-sectional view looking along direction 3—3 of FIG. 1 containing a cut away to show an overflow baffle and an underflow baffle located within the washer.

There is shown in FIGS. 1–3 a complete and preferred embodiment of the present invention. This invention will now be described in detail.

The sequential flow photographic print and film washing unit 10 has opposing parallel sidewalls 11 and 12, paralle endwalls 13 and 14 and a horizontal base 15. The sidewalls 11 and 12 are vertical having slotted upper edges defining a septum 16 and 17 which divides the washing portion of the tank from intake and efflux manifolds 18 and 19. Intake manifold is defined by floor 20, wall 21, sidewall 11 and endwalls 13 and 14. Efflux manifold 19 is defined by floor 22, wall 23, sidewall 12 and endwalls 13 and 14. Endwalls 13 and 14 are also vertical and terminate at a level slightly above that of the slotted septum 16 and 17. Endwalls 13 and 14 and sidewalls 11 and 12 are joined at the edges in a fluid-tight relationship and surround base 15 in a fluid-tight manner to define the washing tank area of the unit. These units may be joined by adhesives or by mechanical means using gaskets. Preferably the sides 11 and 12 are grooved or slotted to accomodate the edges of base 15 as shown in FIG. 2. Similarly ends 13 and 14 are also slotted. Endwalls 13 and 14 are tapered outwardly and upwardly from the base to the outer portion of the manifold floor and then extend straight upwardly as shown in FIG. 1. This is done to accommodate the ends of manifolds 18 and 19; however, separate endwalls could be used for the manifolds if desired. Vertically located within the inside surface of endwalls 13 and 14 are equidistantly spaced grooves 24. Grooves 24 run the full height of the endwalls and are oppositely spaced from each other so that vertical partitions may easily be placed therein or removed therefrom. The partitions are baffles which are alternately placed within the washing tank area of the unit with every other partition being an overflow baffle 25 with the alternating partition being an underflow baffle 26. The overflow baffles 25 are all of uniform size as are the underflow baffles 26. However, the upper edge of overflow baffle 25 is lower than the upper slotted edge of sidewall 11 and 12. The upper edge of underflow baffle 26 is higher than the edge of the overflow baffle 25 and is the same as or lower than the upper edge of endwalls 13 and 14. All baffles run the length of the washing unit between the endwalls 13 and 14 and are parallel to one another in an alternating relationship. The baffles fit within and slide down into grooves 24 provided in the endwalls as described. These baffles fit in a fluid-tight relationship within the grooves but may be removed for purposes of washing and cleaning the unit. The overflow baffles 25 are in a general fluid-tight relationship with endwalls 13 and 14 and with the base 15. The lower edges of overflow baffle 25 preferably fit into grooves 27 in the surface of base 15. The underflow baffles 26 are held above the base 15 in a spaced relationship leaving a full space or slot 28 for fluid flow under the baffle. Underflow baffle 26 may be suspended in grooves 24 within the tank between endwalls 13 and 14 above the base 15 and in the alternative, baffle 26 may contain legs 29 which form a continuation of the outside edges of the baffle and rest on base 15 or in a groove in base 15 as shown in FIGS. 2 and 3.

The space 28 provided for fluid flow under baffle 26 runs the length of the tank between endwalls minus the width allowed for any legs 29. The baffle adjacent to the sidewalls 11 and 12 are underflow baffles 26 with the remainder of the baffles across the tank alternating from overflow baffles 25 to underflow baffles 26. Thus, there is always an even number of underflow baffles and an odd number of overflow baffles dividing the washing area of the unit. Near the lower central portion of an endwall 13 or 14 and just above base 15 is located a drain line capped by a plug 30 by which the tank may be drained of wash water without physically turning and dumping the water over the upper edges of the sidewalls or endwalls. Overflow baffles must be removed for this draining procedure. In the alternative, multiple drain lines and plugs located along one or both endwalls adjacent the base could be employed.

The intake manifold 18 contains an inlet tube 31 and floor 20. Immediately above the inlet tube is a water deflection plate 32 which prevents the splashing or spilling of water at high entry flow rates through tube 31. The deflection plate 32 may be attached to either or both sidewall 11 and opposing manifold wall 21. The efflux manifold 19 has a drain tube 33 in floor 22 by which to remove water flowing over sidewall 12 into the efflux manifold 19. As viewed in FIG. 1, and cut away, the water enters through water inlet tube 31 into the unit manifold and is prevented from splashing as it enters by a splash deflector plate 32 placed directly above the inlet tube 31. The full length of manifold 18 fills with water until the level reaches the lower level of the slots located in septum 16, after which water overflows into the first compartment. The septum is flooded to insure the uniform low of water across the entire length of wall 11 into the partitioned area of the unit. The underflow baffle 26 immediately adjacent wall 11 has a space 28 above the base 15 of the unit as viewed in FIG. 3. Thus the water overflowing the septum 16 through the slots will flow downwardly through space 28 under baffle 26. The water flow continues upwardly in the next compartment over the adjacent overflow baffle 25. Said stream of water continues to flow downwardly and upwardly in such a fashion until it comes to septum 17 and overflows into efflux manifold 19 and is drained via drain tube 33 into disposal means. The sequential flow of wash water through the partition compartments, which are generally about one-half inch in width, is accomplished by the alternate placement of underflow and overflow baffles within the washing part of the unit 10. The flow rate is uniformly distributed by the use of the slotted septum 16. The prints to be washed are placed in each compartment with one print to a compartment. Large prints may be washed by draping or hanging them over the overflow baffle partition 25. The washing rate or number of changes of water within a compartment per unit of time will depend upon the size of the compartment and the rate at which water enters from intake manifold 18. Because each compartment is relatively narrow, the unit can achieve high compartment exchange rates while using minimal amounts of water. With low flow rates, the water requirements are lessened even further. Because of the arrangement of the compartments, fixer laden prints can be added downstream from partially washed prints. Since the upstream prints have lower levels of fixer than those downstream, the upstream water is less contaminated and can be used in washing the downstream prints, thus making maximum use of the wash water.

In the preferred embodiment, the endwalls, sidewalls, base and baffles as well as the manifolds are constructed of a clear material such as glass or plexiglass so that the washing process may be visually regulated and the prints more easily retrieved from within each compartment. Although the preferred embodiment has been illustrated, the shape and size of the unit may be altered without departing from the scope of the invention. For example, more compartments could be added, thereby making the endwalls longer than the sidewalls. Also the baffles could be corrugated to enhance the washing of the prints and prevent any adherence of the prints to the sidewall baffles. Thus, all changes of an equivalent nature may be made without departing from the scope of the invention which is to be limited only by the appended claims.

I claim:

1. A unit for washing photographic prints comprising:

(a) a pair of interconnected vertical parallel sidewalls and endwalls surrounding and interconnecting a horizontal base defining an enclosed washing tank having an open top, (b) an inlet manifold horizontally mounted along the upper portion of one sidewall containing water inlet means and situated to pass water over said sidewall into the washing tank, (c) an efflux manifold horizontally mounted along the upper portion of the opposite sidewall containing water draining means and situated to receive water over said sidewall from said washing tank, (d) a series of alternating parallel vertical equidistantly spaced underflow and overflow baffles attached to said washing tank between said endwalls and parallel to said sidewalls dividing said washing tank into multiple washing compartments, said baffles being arranged such that the baffles adjacent the sidewalls are underflow baffles said underflow baffles being attached to said endwalls such that said baffles provide a flow space between the lower portion thereof and the horizontal base, said overflow baffles terminating at the upper portion thereof at a horizontal level below the level of the upper portion of the underflow baffles thereby providing for the serial flow of water from the intake manifold through each compartment and out the efflux manifold.

2. A unit according to claim 1 wherein each sidewall is slotted along the upper portion thereof and divides the adjacent manifold from the washing tank.

3. A unit according to claim 2 wherein the endwalls contain oppositely facing, equidistantly spaced grooves into which the ends of the overflow and underflow baffles are fitted in a fluid tight manner.

4. A unit according to claim 3 wherein said baffles are removably fitted into said grooves.

5. A unit according to claim 3 wherein the underflow baffles are additionally supported by legs which contact the horizontal base, said legs being extensions of the outside edge portions of said underflow baffle.

6. A unit according to claim 3 wherein the inlet manifold is defined by the upper portion a slotted sidewall, an opposite manifold sidewall and manifold sidewalls, said water inlet means being located in said floor and having located in said floor and having located above said inlet means a horizontal deflector plate to outwardly deflect the flow of water entering the inlet manifold through said inlet means.

7. A unit according to claim 3 wherein the unit is constructed of a transparent material.

8. A unit according to claim 3 wherein the unit contains a closeable draining means in an endwall adjacent the horizontal base.

9. A unit according to claim 4 wherein the lower portion of the overflow baffles additionally are fitted into grooves in the base which grooves are continuous with corresponding grooves in the endwalls.

10. A unit according to claim 6 wherein the efflux manifold is defined by the upper portion of the opposite slotted sidewall, an opposite manifold sidewall and manifold endwalls wherein the endwalls defining the enclosed washing tank are configured to also serve as endwalls to both inlet and efflux manifolds.

* * * * *